US005193295A

United States Patent [19]

Gradenegger et al.

[11] Patent Number: 5,193,295

[45] Date of Patent: Mar. 16, 1993

[54] INSTALLATION FOR SHIFTING WON MINERALS

[75] Inventors: Helmut Gradenegger; Eduard Krivec, both of Zeltweg; Egmont Lammer, Knittelfeld, all of Austria

[73] Assignee: Voest-Alpine Bergtechnik Gesellschaft m.b.H., Alpinestrasse, Austria

[21] Appl. No.: 741,506

[22] PCT Filed: Dec. 4, 1990

[86] PCT No.: PCT/AT90/00116

§ 371 Date: Oct. 2, 1991

§ 102(e) Date: Oct. 2, 1991

[87] PCT Pub. No.: WO91/08351

PCT Pub. Date: Jun. 13, 1991

[30] Foreign Application Priority Data

Dec. 6, 1989 [AT] Austria ..... 2779/89

[51] Int. Cl.[5] ..... E02F 3/348

[52] U.S. Cl. ..... 37/8; 37/118 A; 37/DIG. 15; 414/553; 414/715

[58] Field of Search ..... 37/4, 7, 8, 118 A, DIG. 15, 37/96; 414/546, 551, 553, 715

[56] References Cited

U.S. PATENT DOCUMENTS 3,115,259 12/1963 Wagner .
3,127,038 3/1964 Allaid ..... 37/8 X
3,920,139 11/1975 Nagoshi .
4,116,014 9/1978 Satterwhite ..... 37/96 X

FOREIGN PATENT DOCUMENTS 380451 5/1986 Austria .
1505271 8/1969 Fed. Rep. of Germany ..... 414/487
1431422 9/1969 Fed. Rep. of Germany ..... 414/551
1958714 6/1971 Fed. Rep. of Germany .
2431114 1/1975 Fed. Rep. of Germany ..... 37/4
3200084 7/1982 Fed. Rep. of Germany .
1388703 3/1975 United Kingdom ..... 414/487
2156776 10/1985 United Kingdom .

*Primary Examiner*—Randolph A. Reese
*Assistant Examiner*—Arlen L. Olsen
*Attorney, Agent, or Firm*—Cushman, Darby & Cushman

[57] ABSTRACT

A system for shifting won minerals with a continuous conveyor such as a belt or chain conveyor has a machine frame and a shovel pivotably coupled to booms. The booms are aligned in a vertically pivotable manner with a rocker arm that is pivotably coupled to the front end of the machine frame. The booms and the rocker arm are connected to the front end of the machine frame by hydraulic cylinder units. The loading shovel is swivel-mounted about at least one essentially horizontal axle to dump the debris into a feed chute provided at the front end area of the continuous conveyor. The rocker arm has at least one hydraulic cylinder unit supported at the front end of the machine frame and behind the corresponding rocker arm support to provide a compact design with improved load-bearing capacity and a reduced danger of tipping.

6 Claims, 2 Drawing Sheets

INSTALLATION FOR SHIFTING WON MINERALS

FIELD OF USE OF THE INVENTION

The present invention relates to an installation for shifting won minerals with a continuous conveyor designed in particular as a belt or chain conveyor. This conveyor system comprises a machine frame and a shovel pivotably coupled to booms. The booms are coupled in vertically a pivotable manner to a rocker arm that is pivotably coupled to the front end of the machine frame. The booms and the rocker arm are connected to the front end of the machine frame by hydraulic cylinder units. A feed chute is arranged above the continuous conveyor in the front end area of the machine frame facing the debris. In order to dump the debris into the feed chute, the loading shovel is pivotable about at least one essentially horizontal axle that crosses or intersects the longitudinal axis of the conveyor system and the pivot drive of the booms passes over an angle of traverse. The upper edge of the rear wall of the loading shovel is above the opening of the feed chute and forms the discharge edge of the material picked up by the loading shovel.

DESCRIPTION OF THE PRIOR ART

Conveyor systems for hauling debris or installations for shifting won minerals of the kind described at the beginning are known, for example, from Austrian patent 380 451. With this known device, the picked-up material could be transferred onto a continuous conveyor by swivelling the rocker arm and the booms and by also swivelling the loading shovel, though relatively expensive connecting rod kinematics are required in light of the swivel path required for such an overhead transfer of the picked-up material. The type of coupling and the actuation of the rocker arm and booms in the known device made it necessary to lift and swivel the loading shovel in the longitudinal direction of the machine relatively far from the machine's center of gravity so that a correct distribution of weight in the longitudinal direction of the conveyor system had to be ensured to prevent tipping. In such a device the required stability can be guaranteed only by the appropriate weight and by constructing a correspondingly long continuous conveyor as a counterweight arm.

SUMMARY OF THE INVENTION

The present invention aims to improve a device of the type described at the beginning in such a way that the loadbearing capacity is improved while the danger of tipping is reduced and at the same time conditions are created which permit better manueverability and turning ability of the device without increasing the risk of tipping. With the device according to the present invention, this object is solved by supporting the hydraulic cylinder unit or units for the rocker arm at the front end of the machine frame and behind the corresponding rocker arm support at the front end of the machine frame. Since the hydraulic cylinder unit or units for the rocker arm is or are supported at the front end of the machine frame and behind the corresponding rocker arm support at the front end of the machine frame, a shorter machine (with respect to its longitudinal direction) may be constructed and the condition is created wherein both the rocker arm and the booms move near the front end of the machine frame when they are swivelled overhead to transfer the picked-up material onto a following continuous conveyor. This substantially reduces the danger of tipping. The kinematics chosen in this case for coupling the rocker arm and pivot drive permits a more compact design and in view of the fact that the entire swivel path passes closer to the front edge of the machine frame and thus closer to the tipping edge defined by the front wheels, it is possible to use correspondingly shorter continuous conveyors and thus reduce the entire length of the machine, thereby clearly increasing the manueverability. Supporting the hydraulic cylinder unit for the rocker arm in the manner indicated also offers an improved load-bearing capacity, since pressure acts on the piston side of such a hydraulic cylinder unit when inserting the shovel into the debris and lifting the shovel in sequence. In contrast, comparable designs, such as the above-noted design according to Austrian patent 380 451 accept tensile stress of the pivot drive.

The configuration according to the present invention is designed in a particularly advantageous manner in that, when viewed from the side, the support of the rocker arm at the front end of the machine frame lies between the supports on the side of the machine frame of the hydraulic cylinder units for the pivot drive of the rocker arm and the booms. In such a configuration, hydraulic cylinder units dimensioned in accordance with the forces to be absorbed can be accommodated in space-saving manner without any restrictions or obstructions resulting over the relatively large swivel path of the booms and the shovel. A particularly compact design results if the booms are offset and if the free ends of the booms, to which the shovel is pivotably coupled, run essentially parallel to the hydraulic cylinder unit or units swivelling the booms vertically when the shovel is lowered near the front end of the machine frame.

Apart from the fact that a reduction in the overall length of the machine is possible by improving the kinematics of the pivot drive of the rocker arm and the booms and simultaneously improving the absorption of supporting forces and thus increasing the manueverability and turning ability, this manueverability and turning ability can nevertheless be improved in accordance with a preferred embodiment where the machine frame comprises a front and a rear frame part which are joined together by an articulated joint with an articulated axle running transversely to the longitudinal direction of the machine. The continuous conveyor is formed from two conveyors joined together, their transfer point lying in the articulated joint area of the frame parts. The result of such an articulated joint in the machine frame is that in an angled position the center of gravity position is clearly displaced, whereby the danger of tipping would clearly increase during such swivelling of the rear part of a machine frame compared to the front part of the machine frame if the kinematics to reduce the danger of tipping are not simultaneously improved. Owing to the fact that the path of motion of the loading shovel is on the whole closer to the front edge of the front part of the machine frame and can thus be moved closer to the tipping edge of the front wheels, it is now possible to also use the design known for front-end loaders, for example from German OS 3 200 084, for center pivot steering in a compact device. This simultaneously supports a movable continuous conveyor that can be adapted to requirements.

A particularly compact and short configuration of the pivot drive for the loading shovel relative to the booms or to a crossgrider that is itself again pivotable relative to the booms can be achieved where the drive hydraulic cylinder units for swivelling a crossgrider for the loading shovel and swivelling the loading shovel relative to this crossgrider are arranged to intersect one another. The load-bearing capacity is improved substantially by particularly small structural dimensions, viewed in the longitudinal direction of the machine, and thus the danger of tipping is reduced through this measure.

BRIEF DESCRIPTION OF THE DRAWINGS

The present invention is explained in greater detail herebelow on the basis of an exemplary embodiment schematically illustrated in the drawings.

DETAILED DESCRIPTION OF THE PRESENTLY PREFERRED EMBODIMENTS

Figure 1:
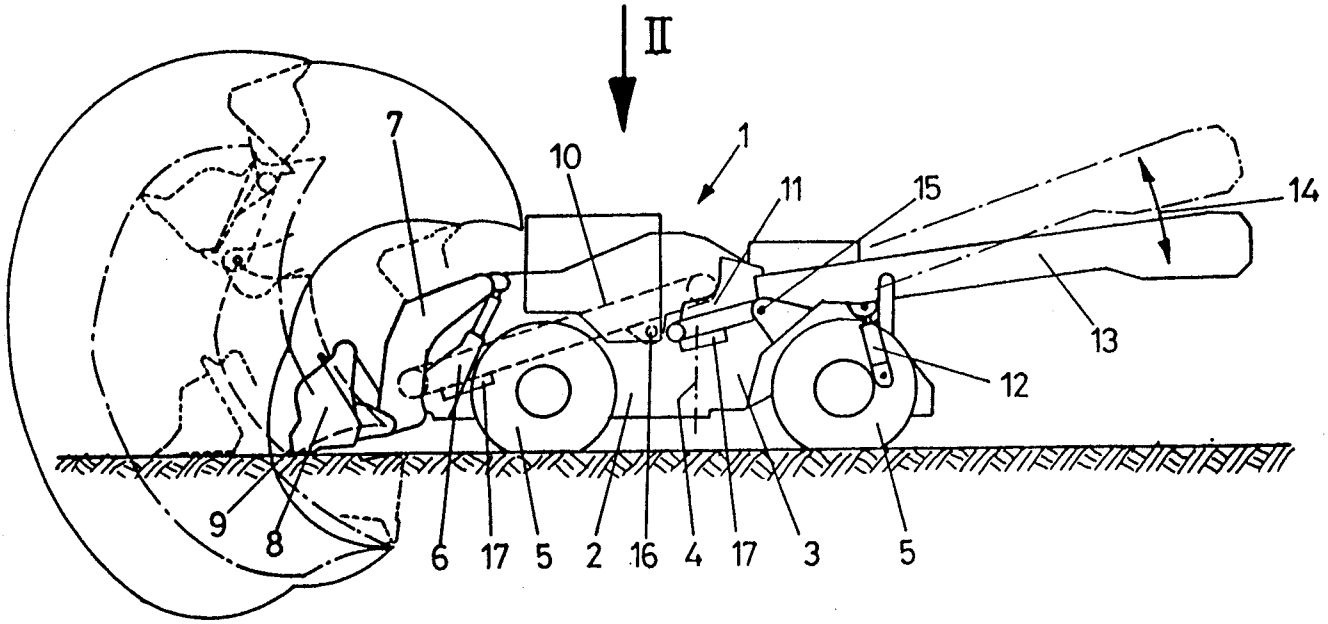
FIG. 1 shows a side view of a conveyor system according to the present invention.
Figure 2:
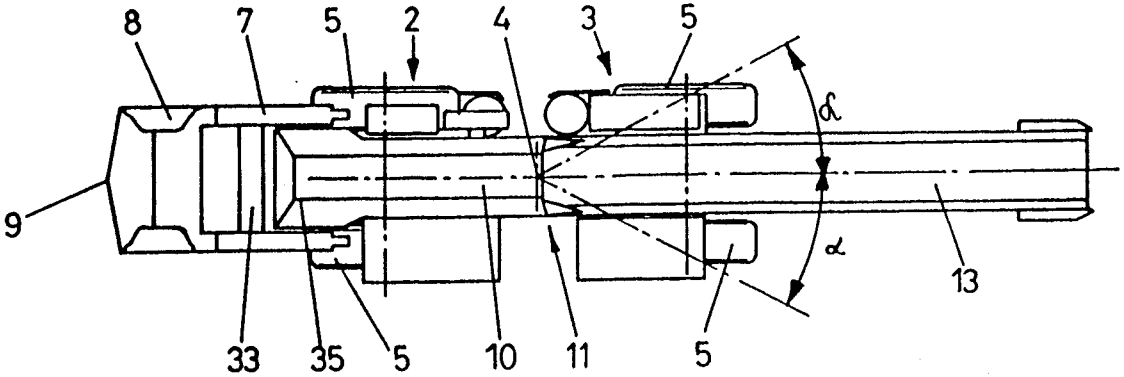
FIG. 2 shows a top view in the direction of arrow II of the conveyor system in FIG. 1.

The device or installation 1 illustrated in FIGS. 1 and 2 comprises a front frame part 2 and a rear frame part 3 which are pivotably connected to one another via a schematically illustrated articulated joint with an axis 4. Frame parts 2 and 3 are movable by means of wheels 5. As illustrated more precisely in FIG. 3, a loading shovel 8 is coupled to the front frame part by a rocker arm 6 and booms 7, whereby the dashed lines in FIG. 1 indicate a few positions of the loading shovel 8 and the associated swivel paths of the front edge 9 of the loading shovel 8. Material or debris picked up by the loading shovel 8 is transferred via a feed chute 35 at the front end area of the front frame part 2 onto a first continuous conveyor 10 designed, for example, as a belt or chain conveyor, and in further sequence is transferred via a transfer station 11 lying in the area of the articulated axle 4 onto a second continuous conveyor 13 which is supported on the rear frame part 3 and which can be raised and lowered by a hydraulic cylinder unit 12. The second conveyor 13 can be raised and lowered by the hydraulic cylinder unit 12 in accordance with the double arrow 14 and is coupled to the rear frame part at 15. Coupling of the first conveyor 10 to the front frame part 2 is indicated by reference numeral 16. To absorb impacts during transfer of the material by the shovel to the first conveyor via the feed chute 35 or during transfer of the material from the first conveyor to the second conveyor in the area of the transfer station 11, the conveyors 10 and 13 are supported on damping blocks 17 so that together with the articulated arrangement of the conveyors 10 and 13, impact loads occurring during transfer of the material can be at least partially damped.

As can be seen from FIG. 2, the rear frame part 3 can be pivoted relative to the front frame part 2 about a relatively large angle $\alpha$ which, for example, can be on the order of magnitude of 30° from the center line, so that when pivoted into one of the two lateral positions indicated by the dashed lines, there is a noticeable displacement of the center of gravity of the entire conveyor system towards the front end of the machine or towards the loading shovel and its coupling.

Figure 3:
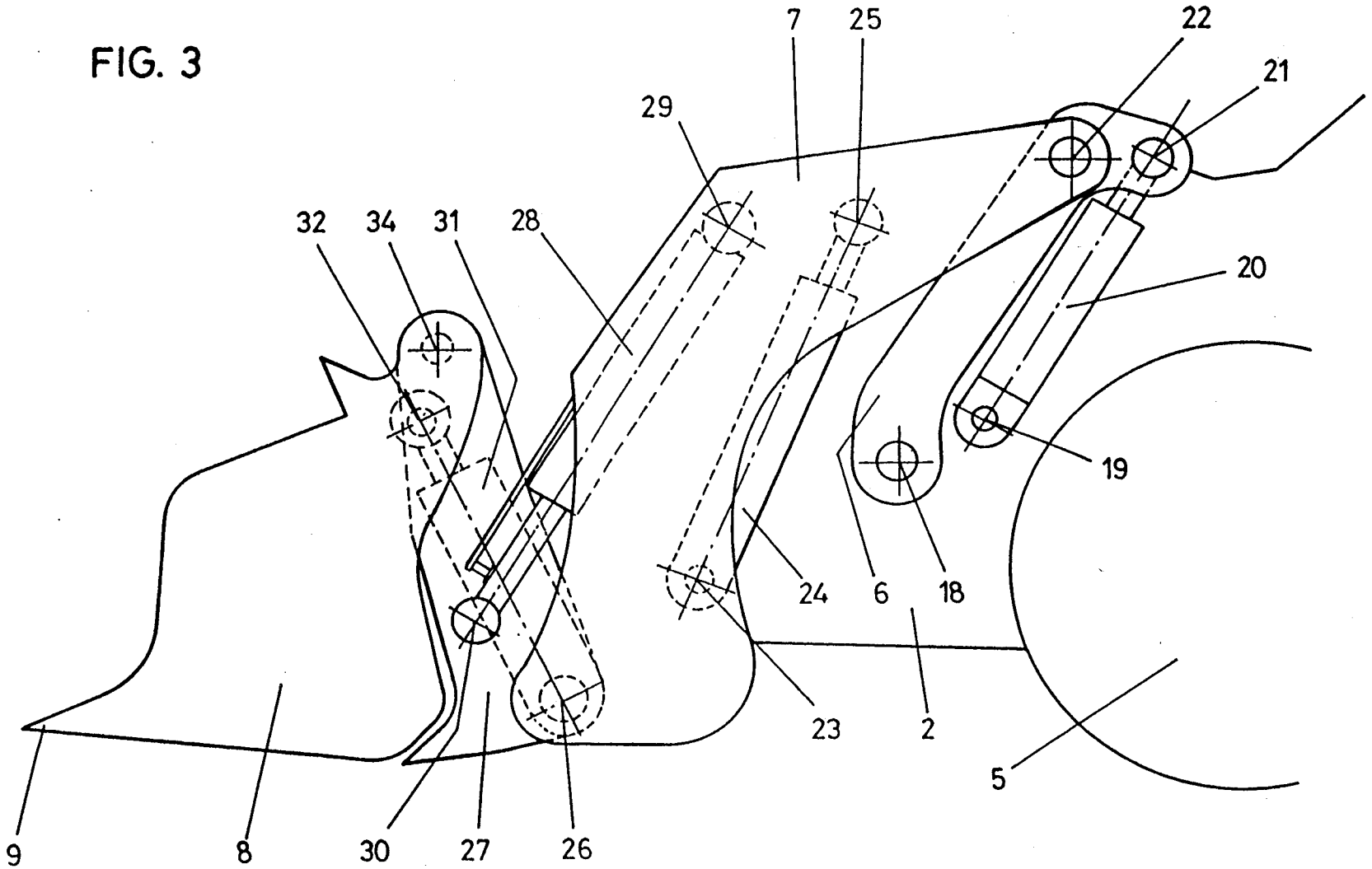
FIG. 3 shows on enlarged scale a side view of the coupling of the loading shovel via booms and rocker arms.

To in every case guarantee minimum stability in machines with a compact overall length without taking steps such as, for example, attaching counterweights, the kinematics illustrated in greater detail in FIG. 3 are chosen for the loading shovel. FIG. 3 illustrates the position closest to the front end of the machine frame. The rocker arm 6 is pivotably coupled at coupling point 18 to the front part 2 of the machine frame and can be pivoted in the direction of movement of the loading shovel 8 towards the debris by a hydraulic cylinder unit 20 which is pivotably coupled to the frame at 19 and which at 21 engages the end of the rocker arm 6 opposite the coupling point 18. Booms 7 are pivotably coupled to the rocker arm 6 at 22 and can be actuated by at least one hydraulic cylinder unit 24 coupled to the machine frame at 23, whereby the hydraulic cylinder unit 24 engages the boom 7 at 25 in the area of the offset. A crossgirder or support 27 for the loading shovel 8 is coupled to the booms 7 at 26. This loading shovel is pivotable by at least one hydraulic cylinder unit 28 via an articulated coupling 29 on the booms and an articulated coupling 30 on the crossgirder or support. To actuate or swivel the shovel relative to the crossgirder 27, this capability being of particular importance when picking up material, at least one additional hydraulic cylinder unit 31 is provided. This at least one cylinder unit engages the crossgirder 27 in the area of the swivel axis 26 of this crossgirder 27 and has a coupling point to the loading shovel 8 which is identified by reference numeral 32. The swivel axis of the loading shovel is identified by reference numeral 34. As can be clearly seen in FIG. 3, a very space-saving design results due to the fact that the hydraulic cylinder unit or units 20 for pivoting the rocker arm 6 is or are coupled, when viewed from the side, to the front end of the machine frame 2 behind the support 18 of the rocker arm. This design is further improved in that the support 18 of the rocker arm 6 on the machine frame is provided between the supports 19 and 23 of the hydraulic cylinder units 20 and 24 on the front frame part 2. When the shovel is pulled back, this results in an almost parallel alignment of the rocker arm 6 with the hydraulic cylinder units 20 and 24. Arranging the hydraulic cylinder unit 20 behind the rocker arm 6, when viewed from the side, further makes it possible that the piston power is effective on hydraulic cylinder unit 20 when inserting the shovel into the debris or material to be picked up. The offset design of the booms 7 favors the parallel arrangement at least of the cylinders 20 and 24 of the rocker arm 6 when completely retracted, so that the loading shovel 8 lies very close to the front wheels.

A further improvement in the compact design also arises when the crossgirder or support 27 is coupled to the booms 7 at 26 close to their lowest point. In this case, the intersecting arrangement of the hydraulic cylinder units 28 and 31 further improves the kinematics of the loading shovel 8, particularly when lifting and discharging material. The first conveyor, which ends in the area between the booms 7, is not illustrated for the sake of clarity. To brace the essentially plate-like booms, cross-struts 33, which are likewise not illustrated in FIG. 3, are shown in FIG. 2.

The compact design of the connecting rod for the loading shovel allows the conveyor system 1 to be loaded parallel to the floor, and flawless operation without the danger of tipping during swivelling movement of the loading shovel in order to transfer material is guaranteed. The danger of tipping must not be ruled out because the conveyor system is used in drifts of relatively low heights and there is no free space up to the roof for tipping the machine and a correspondingly long conveyor that serves as counterweight cannot be used.

Furthermore, moving the shovel parallel to the floor towards the debris to pick up the material can be improved with the proposed geometry for the connecting rod. With the selected arrangement of the hydraulic cylinder units 20 and 24 relative to the coupling of the rocker arm 6, the hydraulic cylinder units 20 and 24 are activated in an actively communicating manner during movement towards the debris. During movement towards the debris, the dead weight results in a higher active resistance for the cylinder pair 20 and 24 and the hydraulic cylinder units 20 first become effective along the lines of a lower resistance through impingement of the hydraulic cylinder units in an actively communicating manner. Following the communicating activation of the hydraulic cylinder units 20 and 24, an appropriate control effects a switch to the independent activation of the individual hydraulic cylinder units, namely, when the shovel is inserted into the debris.

We claim:

1. An apparatus for shifting won minerals for a continuous conveyor such as a belt or chain conveyor, said apparatus comprising:

a machine frame;

a plurality of rocker arms, each of said rocker arms being coupled in a vertically pivotable manner at a first end thereof to said machine frame;

a plurality of booms, each of said booms being pivotably coupled at a first end thereof to a corresponding one of said plurality of rocker arms at a second end of said rocker arms;

a shovel assembly pivotably coupled to each of said plurality of booms at a second end of each of said booms;

a plurality of rocker arm hydraulic cylinder units, each of said rocker arm hydraulic cylinder units being connected at a first end thereof to said machine frame and at a second end thereof to a corresponding one of said plurality of rocker arms, said first rocker arm connection being between said first rocker arm hydraulic cylinder unit connection and a front end of said machine frame, said second rocker arm hydraulic cylinder unit connection being proximate to said first boom connection;

a plurality of boom hydraulic cylinder units, each of said boom hydraulic cylinder units being connected at a first end thereof to said machine frame and at a second end thereof to a corresponding one of said plurality of booms;

a continuous conveyor disposed on a top surface of said machine frame;

a feed chute disposed above the continuous conveyor in a front end area of the machine frame, thereby facing the debris; wherein each of said plurality of booms comprises a first portion proximate to said first end of each of said plurality of booms and a second portion proximate to said second end of each of said plurality of booms, said plurality of boom hydraulic cylinder units each being substantially parallel to said second portion of a corresponding one of said plurality of booms when said shovel assembly is in said first position;

the loading shovel is pivotable about at least one essentially horizontal axle that intersects an essentially vertical plane containing a longitudinal axis of the conveyor system; and said plurality of rocker arms and said plurality of booms may be disposed to place said shovel assembly in a first position proximate to said front end of said machine frame and in a second position, said second position being above an opening of said loading chute so that material in said shovel assembly may be discharged into said feed chute from a surface of said shovel assembly most proximate to said plurality of booms.

2. An apparatus according to claim 1, wherein said first rocker arm connection is disposed between said first boom hydraulic cylinder unit connection and said first rocker arm hydraulic cylinder unit connection.

3. An apparatus according to claim 1 or claim 2, wherein:

said machine frame comprises a front frame part, a rear frame part, and an articulated joint having an articulated axle running transversely to said longitudinal axis of said conveyor; and said continuous conveyor comprises a front conveyor disposed on said front frame part and a rear conveyor disposed on said rear frame part, said front and rear conveyors being joined together at a transfer station disposed at said articulated joint.

4. An apparatus according to claim 1, said shovel assembly comprising:

a plurality of crossgirders, each of said crossgirders being pivotably coupled at a first end thereof to a corresponding one of said booms at a second end of said one of said booms;

a loading shovel pivotably coupled to each of said plurality of crossgirders at a second end of said crossgirders;

a plurality of crossgirder hydraulic units for moving said shovel assembly relative to said plurality of booms, each of said plurality of crossgirders being connected at a first end to a corresponding one of said booms and at a second end to a corresponding one of said crossgirders;

a plurality of shovel hydraulic units for moving said loading shovel relative to said plurality of crossgirders, each of said plurality of shovel hydraulic units being connected at a first end thereof to a corresponding one of said crossgirders and at a second end thereof to said loading shovel; wherein each of said plurality of crossgirder hydraulic cylinder units and the loading shovel hydraulic cylinder unit connected to the same one of said plurality of booms have axes substantially intersecting each other.

5. An apparatus for shifting won minerals for a continuous conveyor such as a belt or chain conveyor, said apparatus comprising:

a machine frame comprising a front frame part, a rear frame part, and an articulated joint having an articulated axle;

a plurality of rocker arms, each of said rocker arms being coupled in a vertically pivotable manner at a first end thereof to said machine frame;

a plurality of booms, each of said booms being pivotably coupled at a first end thereof to a corresponding one of said plurality of rocker arms at a second end of said rocker arms;

a shovel assembly pivotably coupled to each of said plurality of booms at a second end of each of said booms;

a plurality of rocker arm hydraulic cylinder units, each of said rocker arm hydraulic cylinder units being connected at a first end thereof to said machine frame and at a second end thereof to a corresponding one of said plurality of rocker arms, said first rocker arm connection being between said first rocker arm hydraulic cylinder unit connection and a front end of said machine frame;

a plurality of boom hydraulic cylinder units, each of said boom hydraulic cylinder units being connected at a first end thereof to said machine frame and at a second end thereof to a corresponding one of said plurality of booms, said first rocker arm connection being disposed between said first boom hydraulic cylinder unit connection and said rocker arm hydraulic cylinder unit first connection;

a continuous conveyor disposed on a top surface of said machine frame, said continuous conveyor comprising a front conveyor disposed on said front frame part and a rear conveyor disposed on said rear frame part, said front and rear conveyors being joined together at a transfer station disposed at said articulated joint;

a feed chute disposed above the continuous conveyor in a front end area of the machine frame, thereby facing the debris; wherein each of said plurality of booms comprises a first portion proximate to said first end of each of said plurality of booms and a second portion proximate to said second end of each of said plurality of booms, said plurality of boom hydraulic cylinder units each being substantially parallel to said second portion of a corresponding one of said plurality of booms when said shovel assembly is in said first position;

said articulated axle runs transversely to said longitudinal axis of said conveyor;

the loading shovel is pivotable about at least one essentially horizontal axle that intersects an essentially vertical plane containing a longitudinal axis of the conveyor system; and said plurality of rocker arms and said plurality of booms may be disposed to place said shovel assembly in a first position proximate to said front end of said machine frame and in a second position, said second position being above an opening of said loading chute so that material in said shovel assembly may be discharged into said feed chute from a surface of said shovel assembly most proximate to said plurality of booms.

6. An apparatus according to claim 5, wherein said second rocker arm hydraulic cylinder unit connection is proximate to said first boom connection.

* * * * *